US012048397B2

(12) United States Patent
Zhang

(10) Patent No.: US 12,048,397 B2
(45) Date of Patent: Jul. 30, 2024

(54) TISSUE HOLDER

(71) Applicant: Nanchang Kohler Ltd., Nanchang (CN)

(72) Inventor: Kuihua Zhang, Nanchang (CN)

(73) Assignee: NANCHANG KOHLER LTD., Nanchang (CN)

( * ) Notice: Subject to any disclaimer, the term of this patent is extended or adjusted under 35 U.S.C. 154(b) by 67 days.

(21) Appl. No.: 17/991,288

(22) Filed: Nov. 21, 2022

(65) Prior Publication Data

US 2023/0180973 A1 Jun. 15, 2023

(30) Foreign Application Priority Data

Dec. 10, 2021 (CN) ..... 202123107745.2

(51) Int. Cl.
*A47K 10/22* (2006.01)

(52) U.S. Cl.
CPC ..... *A47K 10/22* (2013.01)

(58) Field of Classification Search
CPC ..... A47K 10/22; A47K 2010/3233; A47K 10/38; A47K 10/3836; A47K 10/40
USPC ..... 206/389
See application file for complete search history.

(56) References Cited

U.S. PATENT DOCUMENTS

| | | | | | |
|---|---|---|---|---|---|
| 1,292,640 | A * | 1/1919 | Phelps | A47K 10/38 | 242/597 |
| 3,319,855 | A * | 5/1967 | Tucker | A47K 10/38 | 225/67 |
| 4,427,159 | A * | 1/1984 | Miller | A47K 10/38 | 242/598.6 |
| D300,703 | S * | 4/1989 | Miels | D6/523 | |
| 6,273,359 | B1 * | 8/2001 | Newman | A47K 10/32 | 242/615.4 |
| D471,748 | S * | 3/2003 | Moore | D6/523 | |
| D511,263 | S * | 11/2005 | Ferrer Beltran | D6/523 | |
| D520,279 | S * | 5/2006 | Ferrer Beltran | D6/523 | |
| D520,786 | S * | 5/2006 | Ferrer Beltran | D6/523 | |
| D522,294 | S * | 6/2006 | Ferrer Beltran | D6/523 | |

* cited by examiner

*Primary Examiner* — Andrew D Perreault
(74) *Attorney, Agent, or Firm* — FOLEY & LARDNER LLP

(57) ABSTRACT

A tissue holder includes a mounting bracket, a tube axle, a hanging rod, a cover plate, and a clamping driving mechanism. The tube axle is connected with the mounting bracket. The hanging rod is connected with the tube axle. The cover plate is pivotally mounted on the tube axle. The clamping driving mechanism is arranged between the tube axle and the cover plate. The clamping driving mechanism is configured to drive the cover plate to move toward a side of the hanging rod to clamp roll paper hung on the hanging rod.

20 Claims, 7 Drawing Sheets

TISSUE HOLDER

CROSS REFERENCE TO RELATED APPLICATIONS

This application claims the benefit of and priority to Chinese Patent Application No. 202123107745.2, filed on Dec. 10, 2021, the disclosure of which is incorporated herein by reference in its entirety.

TECHNICAL FIELD

The present disclosure relates to the technical field of sanitary ware. More specifically, the present disclosure relates to a tissue holder.

BACKGROUND

Tissue holders (e.g., tissue holder assemblies) may be used in various commercial and domestic environments such as a bathroom (e.g., lavatory, washroom, restroom, water closet, etc.) or other locations where tissue paper (e.g., toilet paper, roll paper, sanitary paper, toilet paper roll, bathroom tissue paper, etc.) is to be accessible to a user within the environment. Tissue holders may be installed within reach of a user (e.g., within an arm's reach, within 6 feet, etc.) operating sanitary equipment (e.g., using a toilet, a bidet, etc.). Typical tissue holders include a hanging rod generally fixed by a mounting bracket, and then a cover plate is mounted on the mounting bracket, and the cover plate is used for covering a roll of tissue paper hung on the hanging rod. Typical tissue holders require a user to operate with both hands when tearing toilet paper, leading to inconvenience and difficulty in use (e.g., the cover plate does not have a clamping function, but only plays a role of covering the roll of tissue paper). In light of this, it is necessary to provide a tissue holder that alleviates the aforementioned inconvenience and difficulty.

SUMMARY

At least one embodiment relates to a tissue holder including a mounting bracket, a tube axle, a hanging rod, a cover plate, and a clamping driving mechanism. The tube axle is connected with the mounting bracket. The hanging rod is connected with the tube axle. The cover plate is pivotally mounted on the tube axle. The clamping driving mechanism is arranged between the tube axle and the cover plate. The clamping driving mechanism is configured to drive the cover plate to move toward a side of the hanging rod to clamp roll paper hung on the hanging rod.

Another embodiment relates to a tissue holder including a mounting bracket, a tube axle, a hanging rod, a cover plate, and a clamping driving mechanism. The tube axle is connected with the mounting bracket. The hanging rod is connected with the tube axle. The cover plate is pivotally mounted on the tube axle. The clamping driving mechanism is arranged between the tube axle and the cover plate. The clamping driving mechanism is configured to drive the cover plate to move toward a side of the hanging rod to clamp roll paper hung on the hanging rod.

Another embodiment relates to a tissue holder including a mounting bracket, a tube axle, a hanging rod, a cover plate, and a clamping driving mechanism. The tube axle is connected with the mounting bracket. The hanging rod is connected with the tube axle. The cover plate is pivotally mounted on the tube axle. The clamping driving mechanism is arranged between the tube axle and the cover plate. The clamping driving mechanism is configured to drive the cover plate to move toward a side of the hanging rod to clamp roll paper hung on the hanging rod.

In some embodiments, one end of the cover plate sleeved on the tube axle is provided with a cover plate turnup edge. In some embodiments, the clamping driving mechanism includes a rotor pivotally mounted at one end of the tube axle and an elastic driving member for driving the rotor to rotate so as to drive the cover plate to move toward the side of the hanging rod. In some embodiments, the rotor is provided with a rotor boss which keeps in contact with the cover plate turnup edge. In some embodiments, one end of the cover plate turnup edge is provided with an end cover for covering the rotor. In some embodiments, the rotor is connected with the end cover, and the rotor and the end cover are capable of keeping synchronous rotation. In some embodiments, the elastic driving member is a torsion spring, and the torsion spring is assembled between the tube axle and the end cover.

In some embodiments, the end cover is pivotally connected with the tube axle. In some embodiments, the rotor comprises a rotor cylinder, and the rotor boss is arranged on the rotor cylinder. In some embodiments, one end of the rotor cylinder is pivotally connected with the tube axle, and the other end of the rotor cylinder is detachably connected with the end cover. In some embodiments, the torsion spring passes through the rotor cylinder. In some embodiments, one end of the tube axle facing the end cover is fixedly connected with a joint, and one side of the joint facing the end cover is provided with a joint ring.

In some embodiments, one side of the end cover facing the joint is provided with an end cover ring, the end cover is connected with the joint through a pivoting member, and the pivoting member passes through the joint ring and the end cover ring. In some embodiments, one end of the torsion spring is connected with the end cover, and the other end of the torsion spring is connected with the joint; and one end of the rotor cylinder is sleeved on the joint ring, and the rotor cylinder is in clearance fit with the joint ring. In some embodiments, the other end of the rotor cylinder is sleeved on the end cover ring, and the rotor cylinder is clamped with the end cover ring.

In some embodiments, the end cover ring is provided with a clamping block, and one end of the rotor cylinder matched with the end cover ring is provided with a clamping groove. In some embodiments, the clamping block is clamped in the clamping groove. In some embodiments, the joint ring is provided with a joint sleeve extending toward a side of the end cover, and the end cover ring is provided with an end cover sleeve extending toward a side of the joint. In some embodiments, two ends of a body of the torsion spring are sleeved on the joint sleeve and the end cover sleeve respectively. In some embodiments, the joint is detachably connected with the tube axle.

In some embodiments, one end of the hanging rod is connected with one end of the tube axle through a connecting rod, and the clamping driving mechanism is assembled at the other end of the tube axle. In some embodiments, mounting structures of the tube axle and the mounting bracket comprise a left-side mounting structure and a right-side mounting structure. In some embodiments, when the tube axle and the mounting bracket are in the left-side mounting structure, the connecting rod is located at a right side of the mounting bracket. In some embodiments, when the tube axle and the mounting bracket are in the right-side mounting structure, the connecting rod is located at a left side of the mounting bracket.

This summary is illustrative only and should not be regarded as limiting.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Figure 1:
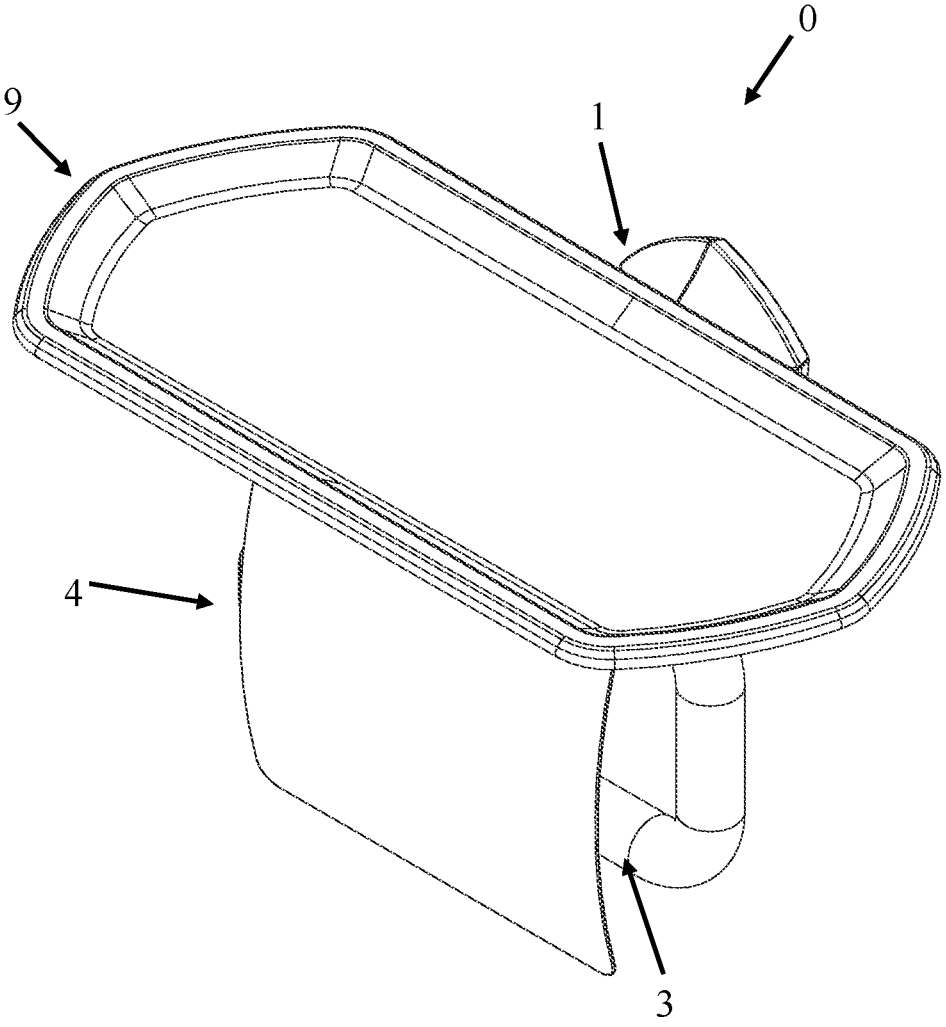
FIG. 1 is an isometric view of a tissue holder, according to some embodiments.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting. The various concepts introduced above and discussed in greater detail below may be implemented in any number of ways, as the described concepts are not limited to any particular manner of implementation. Examples of specific implementations and applications are provided primarily for illustrative purposes.

Embodiments of the application are further described with reference to the drawings hereinafter. Same parts are denoted by same reference numerals. As utilized herein, the terms "front", "back", "left", "right", "up" and "down" refer to the directions in the FIGURES, and the words "inside" and "outside" refer to the directions towards or far away from a geometric center of a specific part, respectively.

Referring generally to the figures, described herein are systems and methods for a tissue holder enabling an efficient and reliable operation for providing portions of tissue paper. In some embodiments, a tissue holder includes a mounting bracket, a tube axle connected with the mounting bracket, and a hanging rod connected with the tube axle and a cover plate pivotally mounted on the tube axle. A clamping driving mechanism may be arranged between the tube axle and the cover plate to drive the cover plate to move toward a side of the hanging rod to clamp roll paper (e.g., a roll of paper) hung on the hanging rod. The clamping driving mechanism may enable and/or bias the cover plate to move toward the side of the hanging rod to clamp the roll paper hung on the hanging rod (e.g., clamp the paper between the hanging rod and cover plate) and support a user endeavoring to attain one-handed operation of the tissue holder (e.g., provide sufficient friction to enable a user to tear toilet paper from a toilet paper roll with one hand), and improves convenience of use. In some embodiments, a user can adjust left and right mounting modes of the tube axle and the hanging rod (e.g., by selectively transitioning the tissue holder between a first mode and a second mode) according to actual needs. The tissue holder described herein facilitates improved convenience for the user to install the tissue paper holder and tissue paper according to the user's actual needs, among other advantages discussed herein.

The application aims at providing a tissue holder with a clamping function to overcome the shortcomings of the prior art. Technical solutions of the application provide a tissue holder including a mounting bracket, a tube axle connected with the mounting bracket, a hanging rod connected with the tube axle and a cover plate pivotally mounted on the tube axle, and a clamping driving mechanism being arranged between the tube axle and the cover plate and for driving the cover plate to move toward a side of the hanging rod to clamp a roll paper hung on the hanging rod.

In one optional technical solution, one end of the cover plate sleeved on the tube axle is provided with a cover plate turnup edge; the clamping driving mechanism comprises a rotor pivotally mounted at one end of the tube axle and an elastic driving member for driving the rotor to rotate so as to drive the cover plate to move toward the side of the hanging rod; and the rotor is provided with a rotor boss which keeps in contact with the cover plate turnup edge.

In one optional technical solution, one end of the cover plate turnup edge is provided with an end cover for covering the rotor; the rotor is connected with the end cover, and the rotor and the end cover are capable of keeping synchronous rotation; and the elastic driving member is a torsion spring, and the torsion spring is assembled between the tube axle and the end cover.

In one optional technical solution, the end cover is pivotally connected with the tube axle.

In one optional technical solution, the rotor comprises a rotor cylinder, and the rotor boss is arranged on the rotor cylinder; one end of the rotor cylinder is pivotally connected with the tube axle, and the other end of the rotor cylinder is detachably connected with the end cover; and the torsion spring passes through the rotor cylinder.

In one optional technical solution, one end of the tube axle facing the end cover is fixedly connected with a joint, and one side of the joint facing the end cover is provided with a joint ring; one side of the end cover facing the joint is provided with an end cover ring, the end cover is connected with the joint through a pivoting member, and the pivoting member passes through the joint ring and the end cover ring; one end of the torsion spring is connected with the end cover, and the other end of the torsion spring is connected with the joint; and one end of the rotor cylinder is sleeved on the joint ring, and the rotor cylinder is in clearance fit with the joint ring; and the other end of the rotor cylinder is sleeved on the end cover ring, and the rotor cylinder is clamped with the end cover ring.

In one optional technical solution, the end cover ring is provided with a clamping block, and one end of the rotor cylinder matched with the end cover ring is provided with a clamping groove; and the clamping block is clamped in the clamping groove.

In one optional technical solution, the joint ring is provided with a joint sleeve extending toward a side of the end cover, and the end cover ring is provided with an end cover sleeve extending toward a side of the joint; and two ends of a body of the torsion spring are sleeved on the joint sleeve and the end cover sleeve respectively.

In one optional technical solution, the joint is detachably connected with the tube axle.

In one optional technical solution, one end of the hanging rod is connected with one end of the tube axle through a connecting rod, and the clamping driving mechanism is assembled at the other end of the tube axle; mounting structures of the tube axle and the mounting bracket comprise a left-side mounting structure and a right-side mounting structure; when the tube axle and the mounting bracket are in the left-side mounting structure, the connecting rod is located at a right side of the mounting bracket; and when the tube axle and the mounting bracket are in the right-side mounting structure, the connecting rod is located at a left side of the mounting bracket.

Employing the various technical solutions described herein can implement the following beneficial effects: (1) The tissue holder 0 disclosed herein enables the cover plate to move toward the side of the hanging rod to clamp the roll paper hung on the hanging rod by configuring the clamping driving mechanism, which is convenient for a user to tear toilet paper with one hand, and improves the convenience of use and (2) in the tissue holder 0 disclosed herein, the clamping driving mechanism is arranged at one end of the tube axle, and the user can adjust the left and right mounting modes of the tube axle and the hanging rod according to the actual needs.

As shown in FIGS. 1-9, a tissue holder 0 (e.g., tissue paper holder assembly, toilet paper holder, tissue holder assembly, sanitary paper holder, roll paper holder, etc.) provided by one embodiment of the application includes a mounting bracket 1, a tube axle 2 connected with the mounting bracket 1, a hanging rod 3 connected with the tube axle 2, and a cover plate 4 pivotally mounted on the tube axle 2.

In some embodiments, a clamping driving mechanism 5 (e.g., a bias mechanism, a clamp biasing mechanism), is arranged between the tube axle 2 and the cover plate 4 to drive the cover plate 4 to move toward a side of the hanging rod 3 to clamp a roll paper (e.g., a roll of toilet paper, a roll of tissue paper, a roll of bathroom tissue paper, etc.) hung on the hanging rod 3.

In some embodiments, the tissue holder 0 is used for placing roll paper (e.g., within an environment such as a bathroom environment). The tissue holder 0 includes the mounting bracket 1, the tube axle 2, the hanging rod 3, the cover plate 4, and the clamping driving mechanism 5.

In some embodiments, the mounting bracket 1 includes a base 11 and a bracket 12, wherein the base 11 is configured to be fixed to a mounting location (e.g., a wall, a shelf, etc.), by a fastener such as a screw, bolt, or other suitable fastener(s). The bracket 12 is used for mounting the tube axle 2, a tray 9 and the like. For example, the bracket 12 includes apertures and other mounting features configured to at least partially engage with at least a portion of one or more of the tray 9, base 11, and tube axle 2 of the tissue holder 0. In some embodiments, the bracket 12 couples the base 11, tube axle 2, and clamping driving mechanism 5. In some embodiments, at least a portion of the clamping driving mechanism 5 is housed within a cavity or space defined by bracket 12.

In some embodiments, the tube axle 2 passes through a mounting hole of the bracket 12 and can be locked by a screw, bolt, threaded member, or other fastener(s). The tube axle 2 may be a hollow tube or a solid axle. One end of the hanging rod 3 is connected with the tube axle 2 through a connecting portion shown as connecting rod 31, and the roll paper may be penetrated from the other end of the tube axle 2 so as to be hung on the hanging rod 3. The hanging rod 3 is offset from and substantially parallel to the tube axle 2, and one end of the hanging rod 3 far away from the connecting rod 31 is provided with a bending portion 32, which functions as a stopper for the roll paper. For example, the roll paper may be hung on the hanging rod between the bending portion 32 and connecting rod 31. The tube axle 2 may be axially offset from the hanging rod 3 by a distance of at least a radius of roll paper or the distance between the outermost surface of roll paper and the innermost surface of the roll paper. The offset distance facilitates convenient installation of roll paper onto the hanging rod 3 and permits rotation of the roll paper installed on the hanging rod 3 while the clamping driving mechanism 5 is not clamping the roll paper. In some embodiments, the tube axle 2, the hanging rod 3 and the connecting rod 31 may be integrally formed (e.g., a unitary body, a monolithic structure).

In some embodiments, the cover plate 4 is mounted on the tube axle 2 and is pivotable and/or rotatable about the tube axle 2 for covering the roll paper hung on the hanging rod 3. For example, the tube axle 2 may define a longitudinal axis and the cover plate 4 may be pivotally coupled to the tube axle 2 such that the cover plate 4 is at least pivotable about the longitudinal axis of the tube axle 2.

In some embodiments, the clamping driving mechanism 5 is assembled between the tube axle 2 and the cover plate 4, and is used for driving (e.g., forcing, biasing, etc.) the cover plate 4 to move toward the side of the hanging rod 3 to clamp the roll paper hung on the hanging rod 3, which is convenient for a user to tear toilet paper with one hand and improves the convenience of use. For example, the clamping driving mechanism 5 may clamp the roll paper between, for example, the hanging rod 3 and the cover plate 4 such that the cover plate 4 generates friction with the roll paper and thus at least partially prevents rotation of the roll paper about the hanging rod 3. In some embodiments, the clamping driving mechanism 5 may clamp the roll paper between the cover plate 4 and the mounting location (e.g., the wall) to generate friction to at least partially prevent rotation of the roll paper about the hanging rod 3.

In some embodiments, the clamping driving mechanism 5 may be selected from an elastic member, a torsion spring, a micro motor and other mechanism. An acting force (e.g., biasing force, clamping force, etc.) of the clamping driving mechanism 5 may be adjusted in advance, and the user can overcome the acting force of the clamping driving mechanism 5 when slowly pulling the roll paper (e.g., toilet paper) downward, so that the roll paper (e.g., toilet paper) can be pulled out (e.g., unrolled from the roll and pulled away from the roll paper).

In some embodiments, when the user needs to tear the roll paper (e.g., toilet paper), the roll paper is temporarily clamped by the cover plate 4, and the user can tear the roll paper (e.g., toilet paper) by tearing the roll paper (e.g., toilet paper) down quickly and forcibly. At the moment of tearing, the roll paper basically keeps no rotation or slightly rotates. For example, the cover plate 4 may at least partially counteract the tearing force, and if rotation of the roll is induced, quickly dampen rotation attributed to rotational inertia of the roll paper.

As shown in FIGS. 1-9, one end of the cover plate 4 sleeved on the tube axle 2 is provided with a cover plate turnup edge 41. The turnup edge 41 may define one or more ends. For example, the turnup edge 41 may include a first end and a second end defined along a longitudinal axis of the turnup edge 41. For example, the right-hand side of the turnup edge 41 in FIG. 7 may define a first end and the left-hand side of the turnup edge 42 in FIG. 7 may define a second end.

Figure 4:
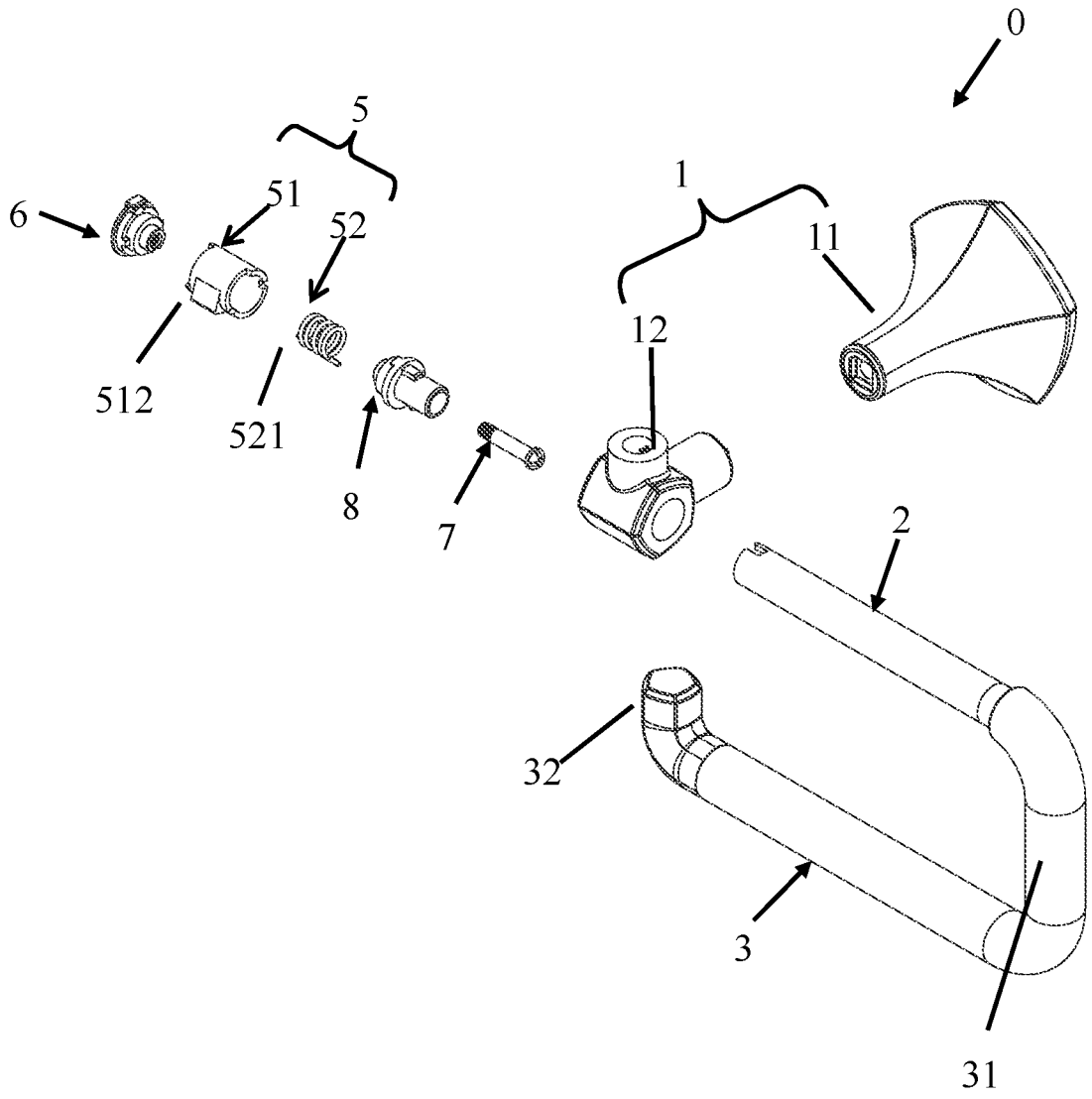
FIG. 4 is an exploded view of the tissue holder including a mounting bracket, a tube axle, a hanging rod, a clamping driving mechanism, an end cover, a pivoting member, and a joint in the tissue holder, according to some embodiments.
Figure 5:
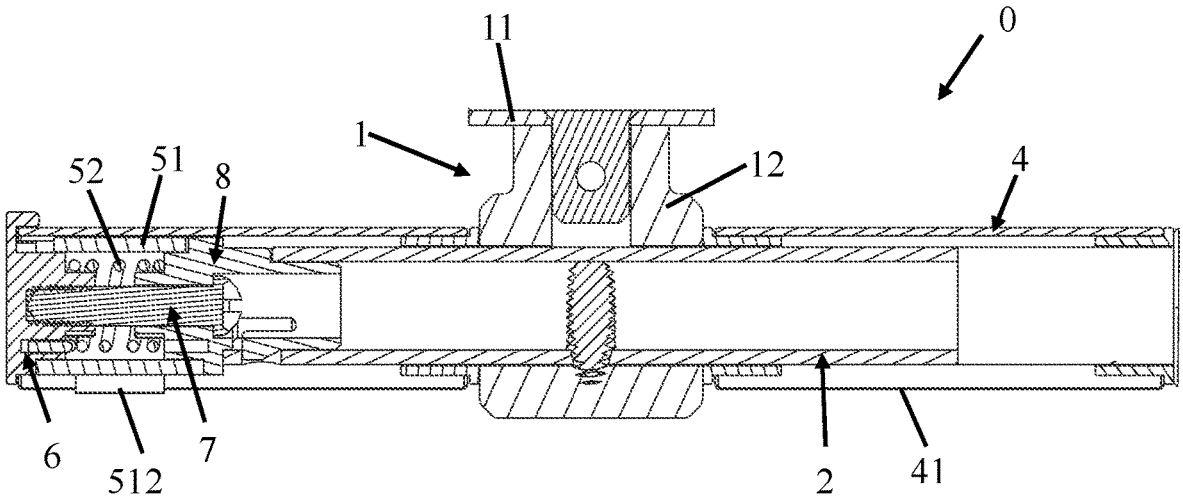
FIG. 5 is an axial sectional view taken along the tube axle of the tissue holder, according to some embodiments.
Figure 6:
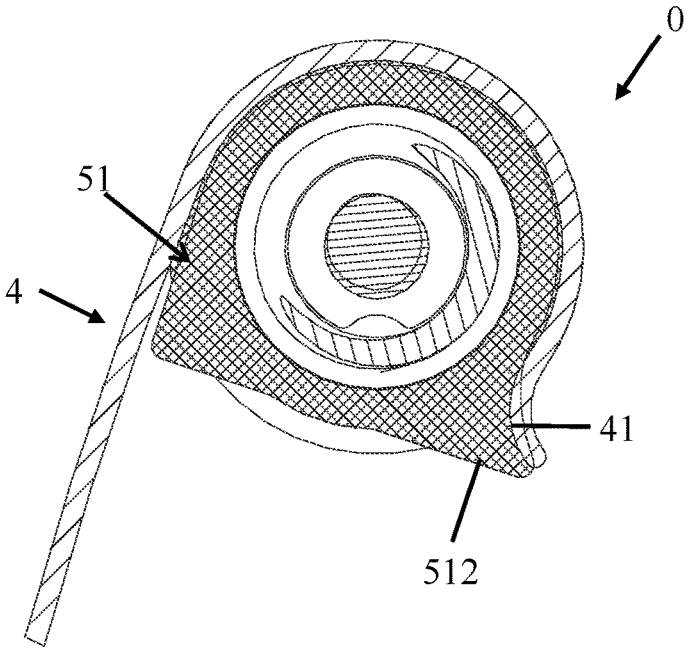
FIG. 6 is a cross-sectional view showing contact between a rotor boss and a cover plate turnup edge of the tissue holder, according to some embodiments.
Figure 7:
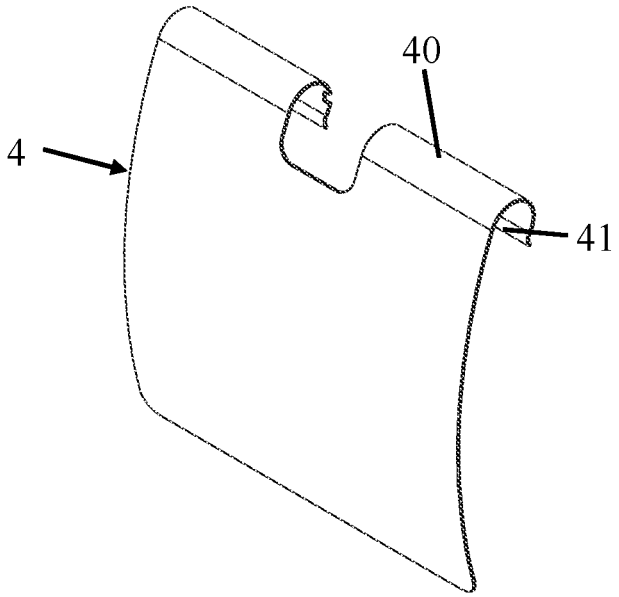
FIG. 7 is an isometric view of a cover plate of the tissue holder, according to some embodiments.

As shown in FIGS. 4-6, the clamping driving mechanism 5 includes a rotor 51 pivotably mounted at one end of the tube axle 2 and an elastic driving member 52 (e.g., spring, torsion spring, elastomeric band, elastomeric bushing, etc.) for driving the rotor 51 to rotate so as to drive the cover plate 4 to move toward the side of the hanging rod 3. The rotor 51 is provided with a rotor boss 512 which keeps in contact with the cover plate turnup edge 41.

In some embodiments, the cover plate 4 is sleeved on the tube axle 2 through a U-shaped portion 40, and can be rotated on the tube axle 2 to realize turning up or covering the cover plate 4. A rear side edge of the U-shaped portion 40 is provided with the cover plate turnup edge 41. The clamping driving mechanism 5 includes the rotor 51 and an elastic driving member 52. The rotor 51 is assembled at one end of the tube axle 2, and can be rotated relative to the tube axle 2. In some embodiments, the rotor 51 is assembled with the tube axle 2 through a rotating shaft. The elastic driving member 52 is assembled between the rotor 51 and the tube axle 2. The rotor 51 is provided with the rotor boss 512 which keeps in contact with the cover plate turnup edge 41.

In some embodiments, the elastic driving member 52 is used for driving the rotor 51 to rotate so as to drive the cover plate 4 to move toward the side of the hanging rod 3, thereby clamping the roll paper hung on the hanging rod 3.

In some embodiments, when the user turns up the cover plate 4 to hang the roll paper, a distance between the cover plate 4 and the hanging rod 3 is longer or an angle between the two is larger. When turning up the cover plate 4, the cover plate turnup edge 41 pushes the rotor boss 512 so as to drive the rotor 51 to rotate, and the rotor 51 compresses the elastic driving member 52. When the user releases the cover plate 4, the elastic driving member 52 acts on the rotor 51 to cause the rotor 51 to rotate, and the rotor boss 512 pushes the cover plate turnup edge 41 so as to drive the cover plate 4 to move towards the side of the hanging rod 3.

Figure 10:
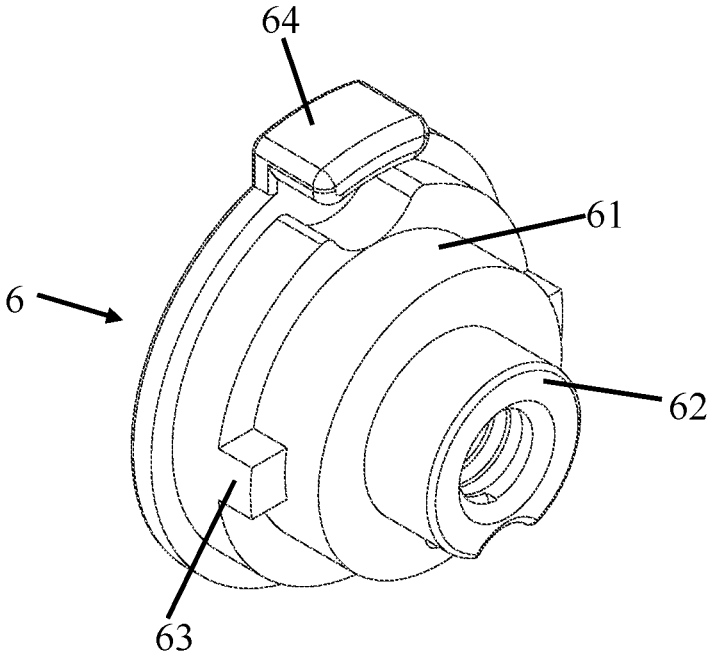
FIG. 10 is an isometric view of an end cover of the tissue holder, according to some embodiments.

In one embodiment, as shown in FIGS. 4-5 and FIG. 10, one end of the cover plate turnup edge 41 is provided with an end cover 6 for covering the rotor 51. The rotor 51 is connected with the end cover 6, and the rotor 51 and the end cover 6 can keep synchronous rotation. The elastic driving member 52 is a torsion spring 521, and the torsion spring 521 is assembled between the tube axle 2 and the end cover 6.

In this embodiment, the inside rotor 51 and the elastic driving member 52 can be covered by configuring the end cover 6 at one end of the cover plate turnup edge 41. The rotor 51 is detachably connected with the end cover 6, and the rotor 51 and the end cover 6 can rotate synchronously. In some embodiments, the elastic driving member 52 is a torsion spring 521, and the torsion spring 521 is assembled between the tube axle 2 and the end cover 6.

When turning up the cover plate 4, the cover plate turnup edge 41 pushes the rotor boss 512 so as to drive the rotor 51 to rotate, then the rotor 51 drives the end cover 6 to rotate, and the end cover 6 compresses the torsion spring 521. When the user releases the cover plate 4, the torsion spring 521 acts on the end cover 6 to cause the end cover to rotate, and the rotor 51 rotates together with end cover, then the rotor boss 512 pushes the cover plate turnup edge 41 so as to drive the cover plate 4 to move towards the side of the hanging rod 3. In some embodiments, an edge of the end cover 6 is provided with a limit plate 64 which is positioned outside the U-shaped portion 40 of the cover plate 4 and plays a role of limiting.

In some embodiments, the end cover 6 is pivotably connected with the tube axle 2. The end cover 6 may be connected with the tube axle 2 through a pivoting member 7, so as to realize axial limit for the end cover 6 and avoid the end cover 6 from separating from the cover plate 4. In this solution, there is no need to configure a mounting part of the end cover 6 on the cover plate 4.

Figure 9:
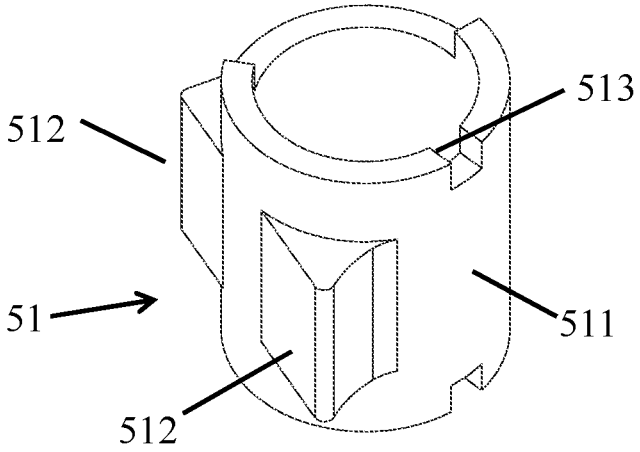
FIG. 9 is an isometric view of a rotor of the tissue holder, according to some embodiments.

As shown in FIGS. 4-5 and FIG. 9, the rotor 51 comprises a rotor cylinder 511, and the rotor boss 512 is arranged on the rotor cylinder 511. One end of the rotor cylinder 511 is pivotably connected with the tube axle 2, and the other end of the rotor cylinder 511 is detachably connected with the end cover 6. In some embodiments, the torsion spring 521 passes through the rotor cylinder 511. In this embodiment, a body of the rotor 51 is the rotor cylinder 511, and the rotor boss 512 is arranged on the rotor cylinder 511. The torsion spring 521 can pass through the rotor cylinder 511 to facilitate assembly of the torsion spring 521.

In some embodiments, during mounting, one end of the rotor cylinder 511 is connected with the tube axle 2 in a clearance fit, and the rotor cylinder 511 can rotate relative to the tube axle 2. The other end of the rotor cylinder 511 is detachably connected with the end cover 6, and the rotor cylinder 511 and the end cover 6 can keep synchronous rotation.

In some embodiments, as shown in FIGS. 4-5 and FIGS. 9-11, one end of the tube axle 2 facing the end cover 6 is fixedly connected with a joint 8, and one side of the joint 8 facing the end cover 6 is provided with a joint ring 81.

In some embodiments, one side of the end cover 6 facing the joint 8 is provided with an end cover ring 61, the end cover 6 is connected with the joint 8 through a pivoting member 7, and the pivoting member 7 passes through the joint ring 81 and the end cover ring 61.

In some embodiments, one end of the torsion spring 521 is connected with the end cover 6, and the other end of the torsion spring 521 is connected with the joint 8. One end of the rotor cylinder 511 is sleeved on the joint ring 81, and the rotor cylinder 511 is in clearance fit with the joint ring 81.

In some embodiments, the other end of the rotor cylinder 511 is sleeved on the end cover ring 61, and the rotor cylinder 511 is clamped with the end cover ring 61. In such embodiments, in order to facilitate the assembly of the end cover 6, the rotor cylinder 511 and the torsion spring 521, and to simplify the main structure of the tube axle 2, one end of the tube axle 2 is fixedly connected with the joint 8, one side of the joint 8 is provided with the joint ring 81, and the joint ring 81 faces the end cover 6.

In some embodiments, an inner side of the end cover 6 is provided with the end cover ring 61, and the end cover 6 is connected with the joint 8 through the pivoting member 7. The pivoting member 7 may be a screw in threaded connection with the end cover 6. The screw is in clearance fit with the joint 8, and can rotate relative to the joint 8. The pivoting member 7 passes through the joint ring 81 and the end cover ring 61.

In some embodiments, one end of the rotor cylinder 511 is sleeved on the joint ring 81, and the two are in clearance fit.

In some embodiments, the other end of the rotor cylinder 511 is sleeved on the end cover ring 61, and the two are clamped, such that the end cover 6 and the rotor 51 keep synchronous rotation.

In some embodiments, a body of the torsion spring 521 passes through the rotor cylinder 511, one end of the torsion spring 521 is inserted into an insertion hole of the end cover 6, and the other end of the torsion spring 521 is inserted into an insertion hole of the joint 8.

As shown in FIGS. 4-5 and 9-10, the end cover ring 61 is provided with a clamping block 63, and one end of the rotor cylinder 511 matched with the end cover ring 61 is provided with a clamping groove 513. The clamping block 63 is clamped in the clamping groove 513 to realize the clamping of the rotor cylinder 511 and the end cover ring 61. According to the need, more than two clamping grooves 513 and clamping blocks 63 may be arranged.

Figure 11:
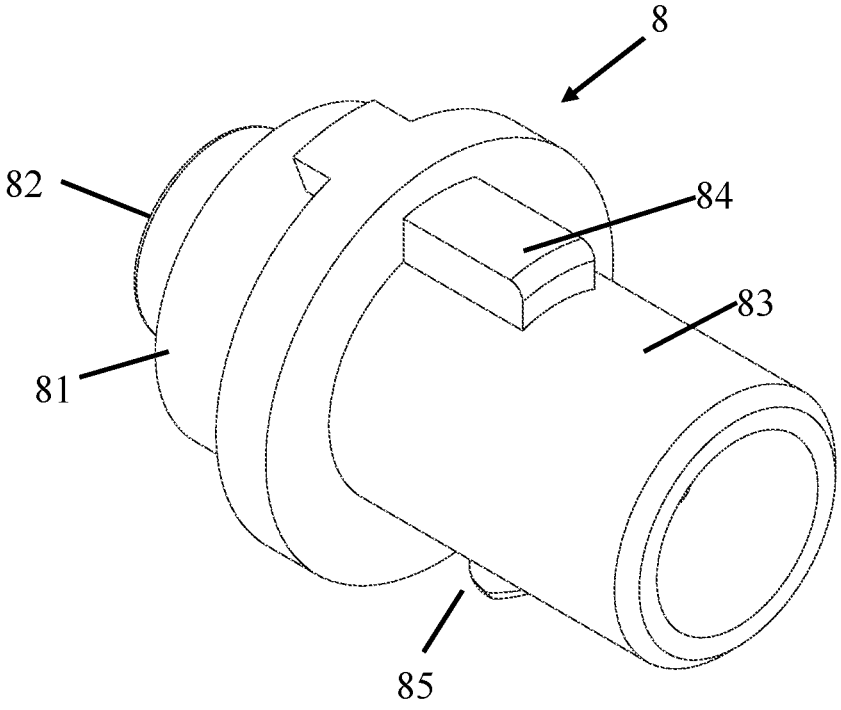
FIG. 11 is an isometric view of a joint of the tissue holder, according to some embodiments.

As shown in FIGS. 5 and 10-11, the joint ring 81 is provided with a joint sleeve 82 extending toward a side of the end cover 6, and the end cover ring 61 is provided with an end cover sleeve 62 extending toward a side of the joint 8. Two ends of a body of the torsion spring 521 are sleeved on the joint sleeve 82 and the end cover sleeve 62 respectively. In such embodiments, by arranging the joint sleeve 82 on the joint ring 81 and the end cover sleeve 62 on the end cover ring 61, the two ends of the body of the torsion spring 521 can be assembled to improve the mounting stability of the torsion spring 521.

Figure 8:
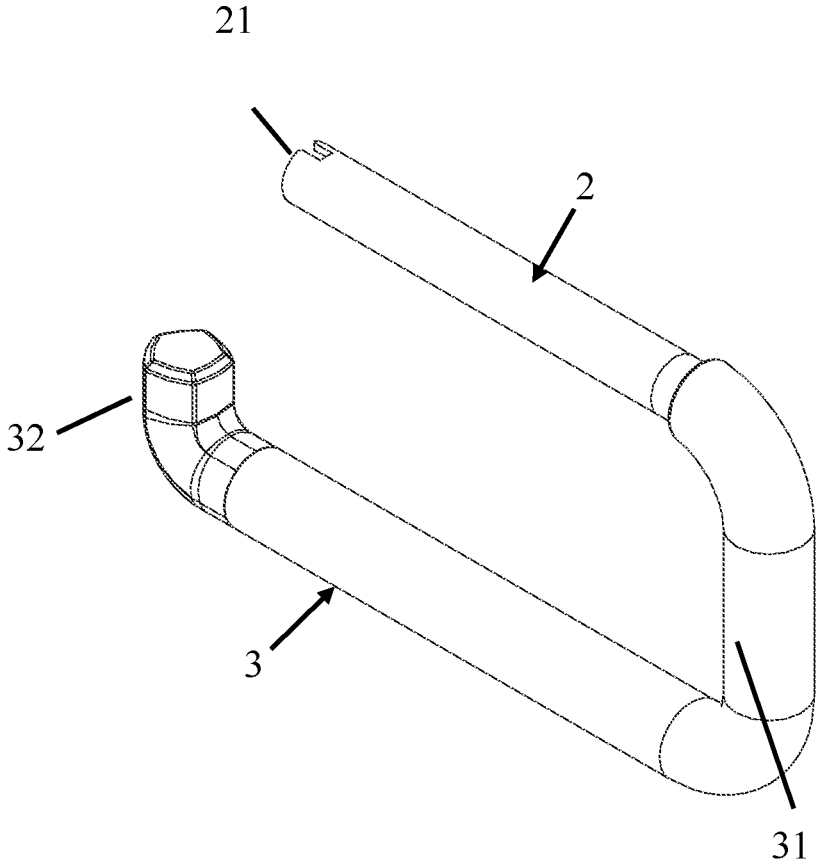
FIG. 8 is an isometric view of a portion of the tissue holder, showing a connection between the tube axle and the hanging rod, according to some embodiments.

As shown in FIGS. 5, 8 and 11, the joint 8 is detachably connected with the tube axle 2, which is convenient for disassembly, repair and replacement. The joint 8 is provided with a plug-in end 83, a bump 84 and a pin shaft 85. The tube axle 2 is a hollow tube with a socket 21 and an insertion hole on a tube wall thereof. The plug-in end 83 is inserted into a central hole of the tube axle 2, and correspondingly, the bump 84 enters the socket 21 to limit circumferential rotation of the plug-in end 83, and the pin shaft 85 enters the insertion hole to limit axial movement of the plug-in end 83.

Figure 2:
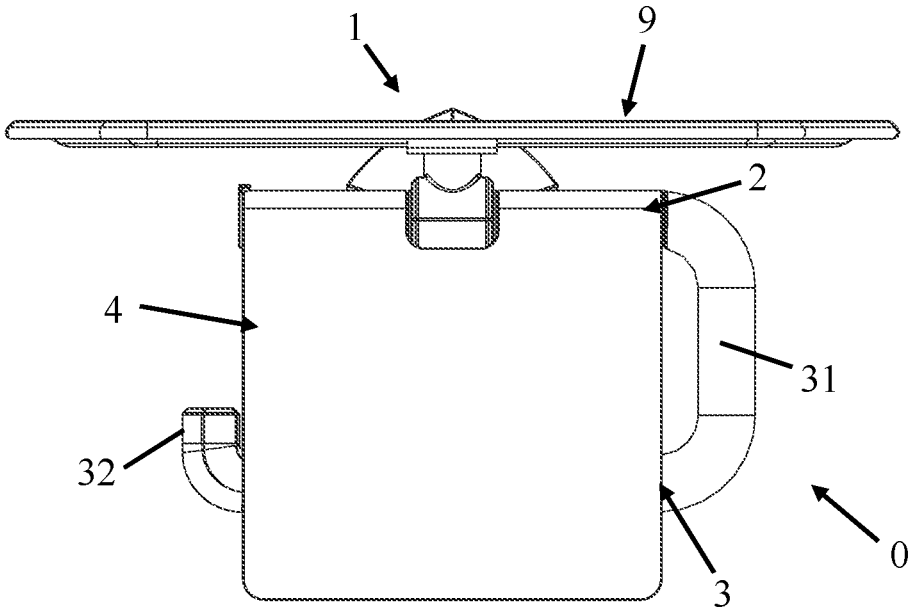
FIG. 2 is a front view of the tissue holder having a tube axle and a mounting bracket are in a right-side mounting structure, according to some embodiments.
Figure 3:
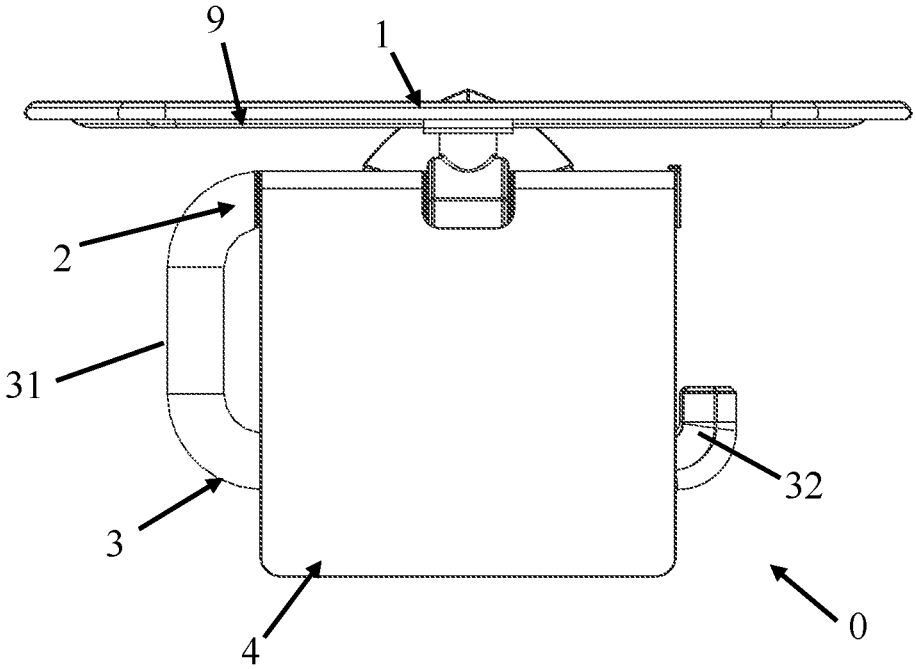
FIG. 3 is a front view of the tissue holder having a tube axle and a mounting bracket are in a left-side mounting structure, according to some embodiments.

As shown in FIGS. 1-3, a tray 9 is mounted above the mounting bracket 1. The tray 9 is mounted above the bracket 12 by a screw, and is used for a user to place articles.

As shown in FIGS. 2-4, one end of the hanging rod 3 is connected with one end of the tube axle 2 through a connecting rod 31, and the clamping driving mechanism 5 is assembled at the other end of the tube axle 2.

In some embodiments, mounting structures of the tube axle 2 and the mounting bracket 1 comprise a left-side mounting structure and a right-side mounting structure. When the tube axle 2 and the mounting bracket 1 are in the left-side mounting structure, the connecting rod 31 is located at a right side of the mounting bracket 1. When the tube axle 2 and the mounting bracket 1 are in the right-side mounting structure, the connecting rod 31 is located at a left side of the mounting bracket 1. In such embodiments, the clamping driving mechanism 5 is arranged at one end of the tube axle 2, and the user can adjust the left and right mounting modes of the tube axle 2 and the hanging rod 3 according to the actual needs, so as to facilitate the mounting according to the site needs.

The tissue holder 0 disclosed by the application enables the cover plate 4 to move toward the side of the hanging rod 3 to clamp the roll paper hung on the hanging rod 3 by configuring the clamping driving mechanism 5, which is convenient for a user to tear toilet paper with one hand, and improves the convenience of use. According to needs, the above technical solutions may be combined to achieve the best technical effect.

The above only describes the principles and the preferable embodiments of the application. It is to be pointed out that for those of ordinary skills in the art, several other modifications can be made on the basis of the principle of the application, which should also be regarded as the scope of protection of the application.

As utilized herein with respect to numerical ranges, the terms "approximately," "about," "substantially," and similar terms generally mean +/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. It is important to note that any element disclosed in one embodiment may be incorporated or utilized with any other embodiment disclosed herein.

What is claimed is:

1. A tissue holder, comprising:

a mounting bracket;

a tube axle connected with the mounting bracket;

a hanging rod connected with the tube axle;

a cover plate pivotally mounted on the tube axle; and a clamping driving mechanism arranged between the tube axle and the cover plate, the clamping driving mechanism configured to drive the cover plate to move toward a side of the hanging rod to clamp roll paper hung on the hanging rod.

2. The tissue holder of claim 1, wherein one end of the cover plate is sleeved on the tube axle and is provided with a cover plate turnup edge;

wherein the clamping driving mechanism comprises:

a rotor pivotally mounted at one end of the tube axle; and an elastic driving member configured to drive the rotor to rotate so as to drive the cover plate to move toward the side of the hanging rod; and wherein the rotor is provided with a rotor boss configured to keep contact with the cover plate turnup edge.

3. The tissue holder of claim 2, wherein one end of the cover plate turnup edge is provided with an end cover for covering the rotor;

wherein the rotor is connected with the end cover, and the rotor and the end cover are capable of keeping synchronous rotation; and wherein the elastic driving member is a torsion spring, and the torsion spring is assembled between the tube axle and the end cover.

4. The tissue holder of claim 3, wherein the end cover is pivotally connected with the tube axle.

5. The tissue holder of claim 4, wherein the rotor comprises a rotor cylinder, and the rotor boss is arranged on the rotor cylinder;

wherein one end of the rotor cylinder is pivotally connected with the tube axle, and the other end of the rotor cylinder is detachably connected with the end cover; and wherein the torsion spring passes through the rotor cylinder.

6. The tissue holder of claim 5, wherein one end of the tube axle facing the end cover is fixedly connected with a joint, and one side of the joint facing the end cover is provided with a joint ring;

wherein one side of the end cover facing the joint is provided with an end cover ring, the end cover is connected with the joint through a pivoting member, and the pivoting member passes through the joint ring and the end cover ring;

wherein one end of the torsion spring is connected with the end cover, and the other end of the torsion spring is connected with the joint; and one end of the rotor cylinder is sleeved on the joint ring, and the rotor cylinder is in clearance fit with the joint ring; and wherein the other end of the rotor cylinder is sleeved on the end cover ring, and the rotor cylinder is clamped with the end cover ring.

7. The tissue holder of claim 6, wherein the end cover ring is provided with a clamping block, and one end of the rotor cylinder matched with the end cover ring is provided with a clamping groove; and wherein the clamping block is clamped in the clamping groove.

8. The tissue holder of claim 6, wherein the joint ring is provided with a joint sleeve extending toward a side of the end cover, and the end cover ring is provided with an end cover sleeve extending toward a side of the joint; and wherein two ends of a body of the torsion spring are sleeved on the joint sleeve and the end cover sleeve respectively.

9. The tissue holder of claim 6, wherein the joint is detachably connected with the tube axle.

10. The tissue holder according to any one of claim 1, wherein one end of the hanging rod is connected with one end of the tube axle through a connecting rod, and the clamping driving mechanism is assembled at the other end of the tube axle;

wherein mounting structures of the tube axle and the mounting bracket comprise a left-side mounting structure and a right-side mounting structure;

wherein when the tube axle and the mounting bracket are in the left-side mounting structure, the connecting rod is located at a right side of the mounting bracket; and wherein when the tube axle and the mounting bracket are in the right-side mounting structure, the connecting rod is located at a left side of the mounting bracket.

11. A tissue holder, comprising:

a mounting bracket;

a tube axle connected with the mounting bracket;

a hanging rod connected with the tube axle;

a cover plate pivotally mounted on the tube axle; and a clamping driving mechanism configured to bias the cover plate toward a side of the hanging rod.

12. The tissue holder of claim 11, wherein the clamping driving mechanism comprises:

a rotor pivotally mounted at one end of the tube axle; and an elastic driving member configured to drive the rotor to rotate so as to drive the cover plate to move toward the side of the hanging rod.

13. The tissue holder of claim 12, wherein the elastic driving member is a torsion spring, and the torsion spring is assembled between the tube axle and an end cover.

14. The tissue holder of claim 12, wherein one end of the cover plate is sleeved on the tube axle and is provided with a cover plate turnup edge; and wherein the rotor is provided with a rotor boss configured to keep contact with the cover plate turnup edge.

15. A tissue holder, comprising:

a mounting bracket;

a tube axle connected with the mounting bracket;

a hanging rod connected with the tube axle;

a cover plate pivotally mounted on the tube axle; and a clamping driving mechanism comprising an elastic driving member arranged between the tube axle and the cover plate to drive the cover plate to move toward a side of the hanging rod.

16. The tissue holder of claim 15, wherein one end of the hanging rod is connected with one end of the tube axle through a connecting rod, and the clamping driving mechanism is assembled at the other end of the tube axle.

17. The tissue holder of claim 16, wherein mounting structures of the tube axle and the mounting bracket comprise a left-side mounting structure and a right-side mounting structure;

wherein when the tube axle and the mounting bracket are in the left-side mounting structure, the connecting rod is located at a right side of the mounting bracket; and wherein when the tube axle and the mounting bracket are in the right-side mounting structure, the connecting rod is located at a left side of the mounting bracket.

18. The tissue holder of claim 15, wherein the cover plate includes a cover plate turnup edge;

wherein one end of the cover plate turnup edge is provided with an end cover;

wherein one end of the tube axle facing the end cover is fixedly connected with a joint; and wherein one side of the joint facing the end cover is provided with a joint ring.

19. The tissue holder of claim 18, wherein the joint ring is provided with a joint sleeve extending toward a side of the end cover, and an end cover ring is provided with an end cover sleeve extending toward a side of the joint.

20. The tissue holder of claim 15, wherein one end of the cover plate is sleeved on the tube axle and is provided with a cover plate turnup edge.

* * * * *